US005440467A

United States Patent [19]

Lautzenheiser

[11] Patent Number: 5,440,467

[45] Date of Patent: Aug. 8, 1995

[54] TASK LIGHT

[75] Inventor: Terry L. Lautzenheiser, Grand Haven, Mich.

[73] Assignee: Steelcase Inc., Grand Rapids, Mich.

[21] Appl. No.: 231,280

[22] Filed: Apr. 22, 1994

[51] Int. Cl.[6] ..... F21S 3/00

[52] U.S. Cl. ..... 362/222; 362/223; 362/234; 362/255

[58] Field of Search ..... 362/222, 223, 224, 255, 362/256

[56] References Cited

U.S. PATENT DOCUMENTS

| | | |
|---|---|---|
| 2,297,124 | 9/1942 | Anderson et al. . |
| 2,345,235 | 3/1944 | Carter, Jr. . |
| 2,366,216 | 1/1945 | Roberts . |
| 2,741,694 | 4/1956 | Thomstad et al. . |
| 2,820,918 | 1/1958 | Aronstein . |
| 3,140,055 | 7/1964 | Long . |
| 3,225,515 | 12/1965 | Orr . |
| 3,288,990 | 11/1966 | Stahlhut . |
| 3,720,826 | 3/1973 | Gilmore et al. . |
| 3,746,854 | 7/1973 | Brass . |
| 3,829,677 | 8/1974 | DeLlano . |
| 4,054,793 | 10/1977 | Shemitz . |
| 4,164,009 | 8/1979 | Maguire, Jr. et al. . |

(List continued on next page.)

OTHER PUBLICATIONS

"Materials and Optics for Solar Energy Conversion and Advanced Lighting Technology", dated Aug. 1986, published by the International Society for Optical Eng., St. Paul, Minnesota, which discloses light guides including longitudinally extending triangularly-shaped ridges on an exterior side.

Product brochure entitled "One Bulb in here sheds a whole new light on applications and cost", undated, published by 3M Co., St. Paul, Minnesota, discloses a SCOTCHLAMP TM film for diffusing light.

Product brochure entitled "Threaded Globes—Lexalite ® Models 510–538", undated, published by Lexalite International Corp., Charlevoix, Michigan, which discloses prismatic lenses.

Product brochure entitled "Corridor Light with Wrap-Around White Ribbed Diffuser", undated, published by House-O-Lite Corp., Chicago, Illinois, which discloses a ribbed diffuser.

Exhibit E is a brochure entitled "Scotchlamp Film TM", undated, published by 3M, which discloses ribbed diffusers and light assemblies.

Brochure entitled "Cylinder Brackets", undated, by Marco Company, address unknown which discloses prismatic cylinders for light sources.

A brochure entitled "Lytetube", copyright 1976, published by Lightolier, Inc., which discloses a lens including an interior surface with prisms.

An article entitled "Piping Lighting", dated May 1988, published in Popular Science, pp. 76–79 and 117, which discloses plastic tubes including plastic tubes having molded-in sawtooth patterns of prisms.

A product brochure in prior art entitled "Lorin Lighting Products", published by Lorin Industries of Muskegon, Michigan.

*Primary Examiner*—Carroll B. Dority

*Attorney, Agent, or Firm*—Price, Heneveld, Cooper, DeWitt & Litton

[57] ABSTRACT

A light assembly is provided for illuminating a worksurface below and in front of the light assembly. The light assembly includes a housing configured for mounting over the worksurface below an overhead cabinet or shelf, and an elongated linear light source such as a fluorescent light bulb supported in the housing. A step reflector is supported by the housing for reflecting light generated by the light source onto the worksurface therebelow, and a tubular lens is mounted telescopically onto the light source. The tubular lens includes prism-shaped triangular rings on its inside surface for controlling the light from the light source onto the worksurface therebelow. The tubular lens includes end sections and intermediate sections that can be selectively assembled together to cover the light source. By selectively including zero, one, or more of the intermediate sections, a variety of different length linear light sources can be covered.

33 Claims, 4 Drawing Sheets

U.S. PATENT DOCUMENTS 4,218,727 8/1980 Shemitz et al. .
4,233,651 11/1980 Fabbri .
4,242,723 12/1980 Fabbri et al. .
4,260,220 4/1981 Whitehead .
4,298,916 11/1981 Shemitz .
4,300,185 11/1981 Wakamatsu .
4,344,111 8/1982 Ruud et al. .
4,388,676 6/1983 Sato et al. .
4,432,044 2/1984 Lautzenheiser .
4,434,453 2/1984 Campbell .
4,450,513 5/1984 Guggemos .
4,517,631 5/1985 Mullins .
4,542,449 9/1985 Whitehead .
4,562,515 12/1985 Lautzenheiser .
4,564,888 1/1986 Lewin et al. .
4,615,579 10/1986 Whitehead .
4,617,612 10/1986 Pritchett .
4,622,624 11/1986 McCarthy et al. .
4,669,033 5/1987 Lee .
4,669,034 5/1987 Bansbach et al. .
4,683,526 7/1987 Krogsrud et al. .
4,719,546 1/1988 Spitz .
4,733,332 3/1988 Yamashita et al. .
4,748,543 5/1988 Swarens .
4,924,368 5/1990 Northrop et al. .
4,941,071 7/1990 Knauf .
4,969,075 11/1990 Helm et al. .
4,991,070 2/1991 Stob .
5,036,436 7/1991 Rattigan et al. .
5,051,878 9/1991 Ngai .
5,062,030 10/1991 Figueroa .
5,079,680 1/1992 Kohn .
5,086,375 2/1992 Fabbri et al. .
5,101,330 3/1992 Suzuki .
5,115,380 5/1992 Huisingh et al. .
5,146,393 9/1992 Crane .
5,192,129 3/1993 Figueroa .
5,193,899 3/1993 Oe et al. .
5,205,632 4/1993 Crinion .
5,226,719 7/1993 Feldpausch et al. .

TASK LIGHT

BACKGROUND OF THE INVENTION

The present invention concerns light assemblies, and in particular, concerns a light assembly for illuminating a worksurface with well dispersed, non-glaring light.

Offices and the like are often furnished with workstation based furniture systems which include one or more worksurfaces, and further which include personalized lighting to provide adequate working light for performing tasks on the worksurfaces. In many furniture systems, the working light is provided by light fixtures mounted under overhead cabinets and shelves. The worksurfaces are located generally below the overhead cabinets and shelves, but also extend forward of the overhead cabinets and shelves. Thus, the working light from the light fixtures must be protected/reflected forwardly to fully illuminate the worksurface. A variety of configurations of light fixtures have been designed for this purpose. For example, U.S. Pat. No. 4,941,071 to Knauf discloses one such lighting fixture. However, reflected light and/or unreflected light emitted from a linear light source such as a fluorescent light bulb tends to illuminate unevenly, such that there are annoying shadows and uneven areas of light on the worksurface. Efforts to better disperse the light have resulted in light fixture designs including lenses which are costly to provide and assemble; which make bulb replacement cumbersome and difficult; and which detract from the aesthetics of the light fixtures.

Aside from uniformity of light distribution, the known light fixtures often include controls that are difficult to see or reach. Also, assembly and/or installation of the light fixtures can be difficult. Further, many known light fixtures require multiple specialized parts for each style light fixture. Thus, a more modular design is desired having a higher number of common parts between light fixtures and which is easier to assemble and install.

Thus, a light assembly solving the aforementioned problems is desired.

SUMMARY OF THE INVENTION

In one aspect, the present invention includes a light assembly for illuminating a task supported on a horizontal surface below and in front of the light assembly. The light assembly includes an elongated housing configured for mounting over the horizontal surface, an elongated linear light source supported in the housing, and a step reflector supported by the housing for reflecting light generated by the light source onto the task. A tubular lens is mounted on the light source for controlling the light from the light source. In a preferred form, controls for operating the light source are located in a front portion of the elongated housing along with a transformer for operating the light source, and a specular reflector is used with the tubular lens to control light emitted by the light source.

In another aspect, the present invention includes a lens assembly with use with an elongated linear light source to control light from the light source. The lens assembly includes first and second tubular lens sections, each of which define an interior space for telescopingly receiving the light source. The first and second lens sections includes interior ends configured to engage and register against each other, and further include prism simulating surfaces which control light from the light source.

These and other features and advantages of the present invention will be further understood and appreciated by those skilled in the art by reference to the following specification, claims and appended drawings.

DETAILED DESCRIPTION OF PREFERRED EMBODIMENT

Figure 1:
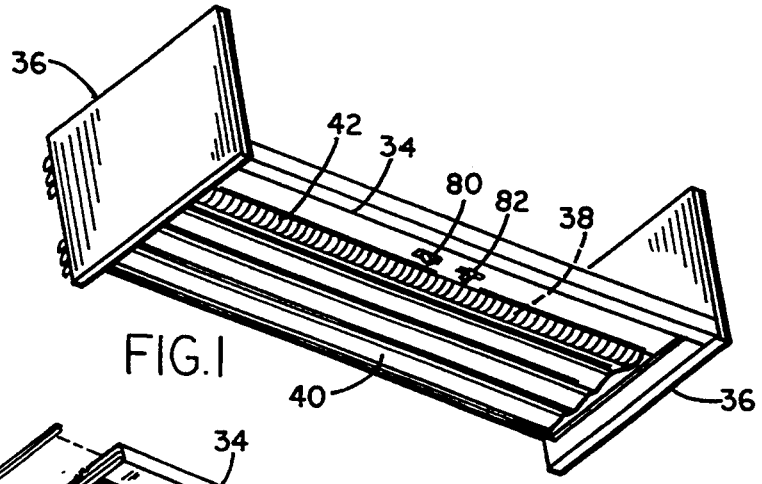
FIG. 1 is a bottom side perspective view of a light assembly embodying the present invention, the light assembly being mounted to the underside of a bookshelf.
Figure 2:
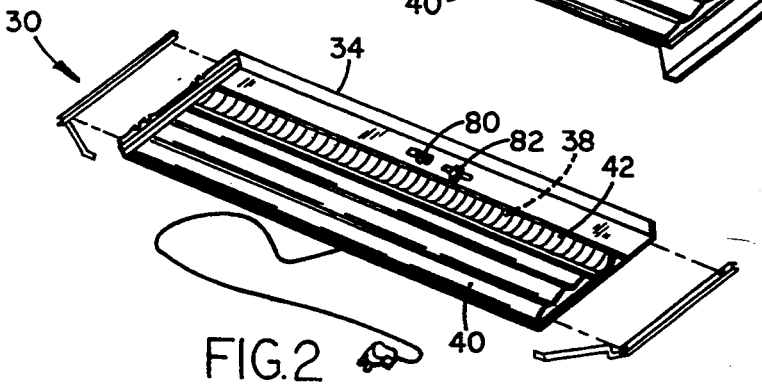
FIG. 2 is a partially exploded, bottom perspective view of the light assembly shown in FIG. 1.

For purposes of description herein, the terms "upper," "lower," "right," "left," "rear," "front," "vertical," "horizontal," and derivatives thereof shall relate to the invention as oriented in FIG. 1, such as if a person was standing in front of the arrangement shown in FIG. 1. However, it is to be understood that the invention may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
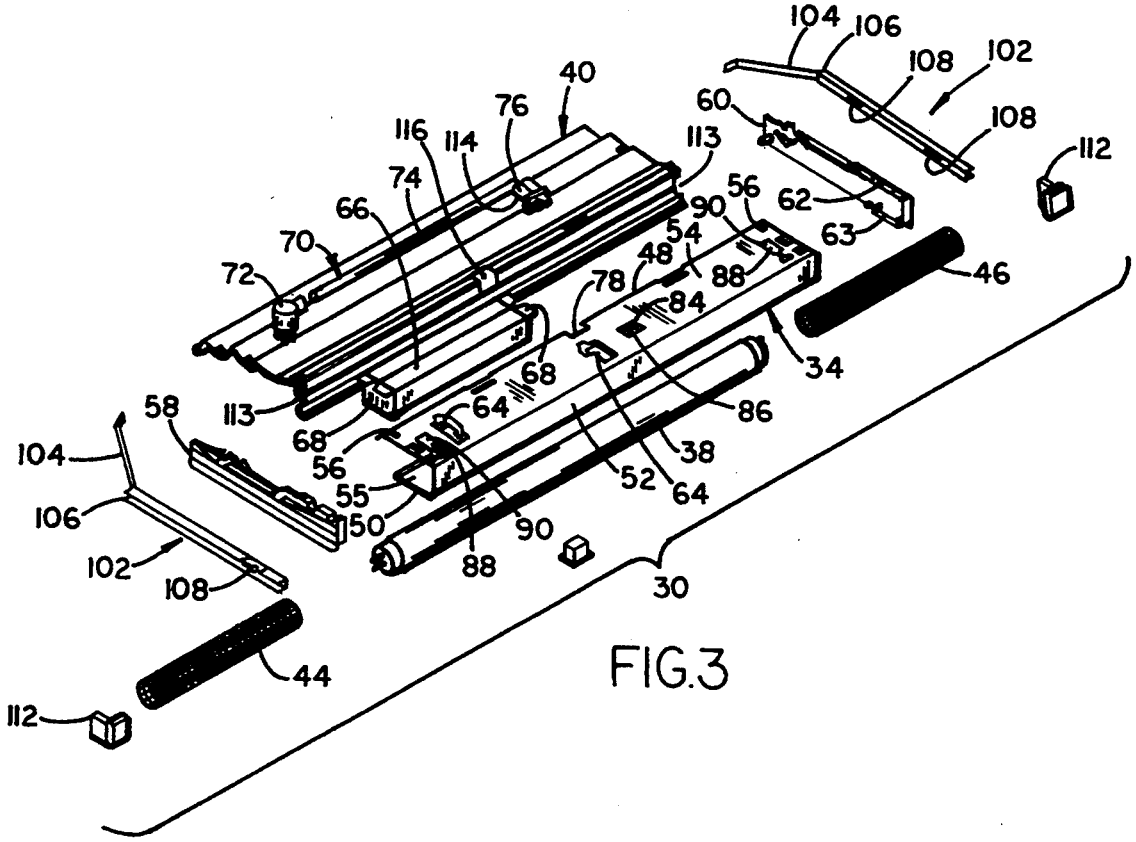
FIG. 3 is an exploded, top perspective view of the light assembly shown in FIG. 2.
Figure 4:
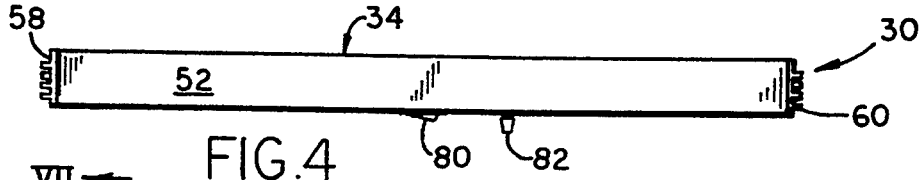
FIG. 4 is a front view of the light assembly shown in FIG. 2.
Figure 5:
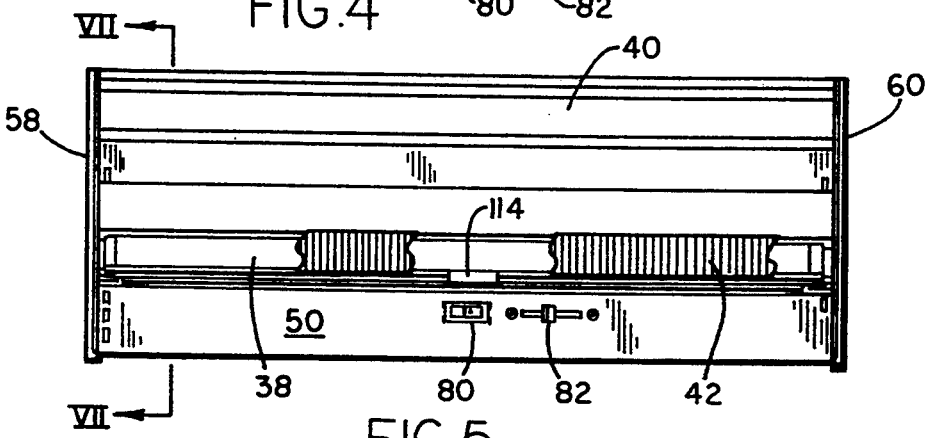
FIG. 5 is a bottom plan view of the light assembly shown in FIG. 2, the lens being partially broken away to expose the linear fluorescent light source.
Figure 6:
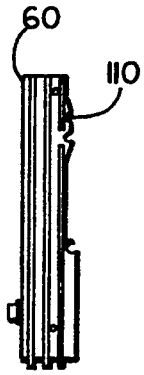
FIG. 6 is a side view of the light assembly shown in FIG. 5.
Figure 7:
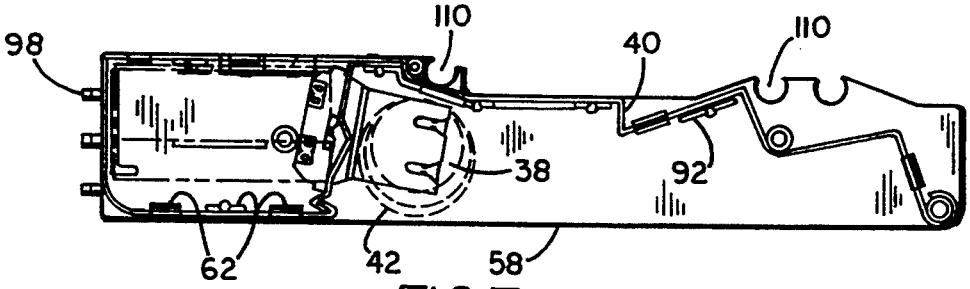
FIG. 7 is a cross-sectional view taken along the lines VII—VII in FIG. 5.
Figure 8:
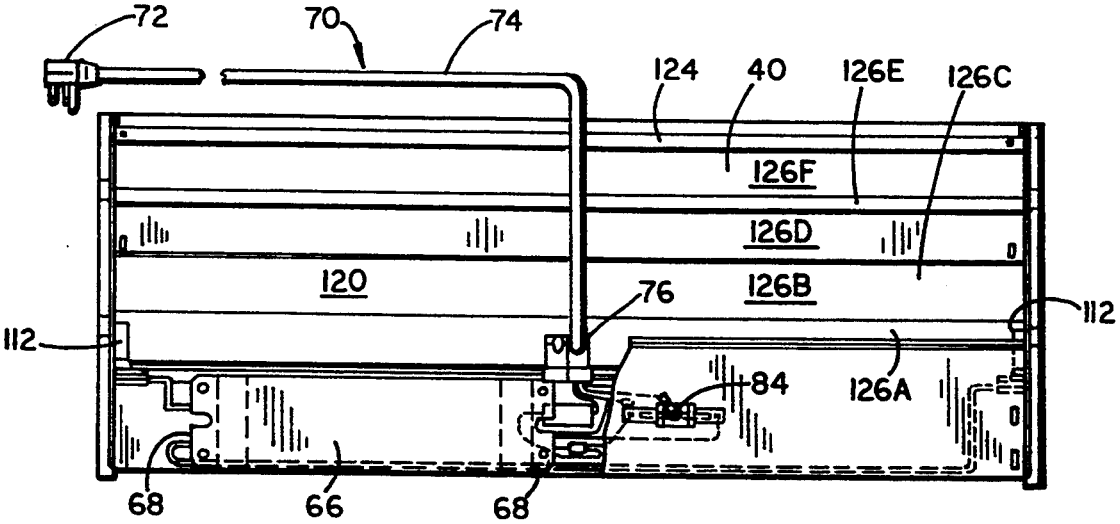
FIG. 8 is a top plan view of the light fixture shown in FIG. 5, the housing being partially broken away to reveal the transformer for the light source.

A light assembly 30 (FIG. 1) is provided for illuminating a worksurface 32 (FIG. 19) positioned generally below and in front of the light assembly 30. The light assembly 30 (FIG. 1) includes a housing 34 configured for mounting over the worksurface, such as to the bottom of an overhead cabinet or shelf 36. An elongated linear light source, such as a fluorescent light bulb 38, is supported in the housing 34. A step reflector 40 is supported by the housing 34 and is located generally over the light source 38 for reflecting light generated by the light source onto the task located on the worksurface 32. A tubular lens 42 is telescopically slid onto the light source 38. Lens 42 includes an interior surface defining a plurality of prism-shaped triangular rings for controlling the light frown light source 38 which reduce glare and provide a more uniform distribution of light on worksurface 32. Tubular lens 42 is comprised of two end sections 44 (only one of which is shown in FIG. 3) and a selected number of intermediate sections 46, which sections 44 and 46 can be assembled in various combinations to provide a tubular lens 42 of a desired length.

Figure 9:
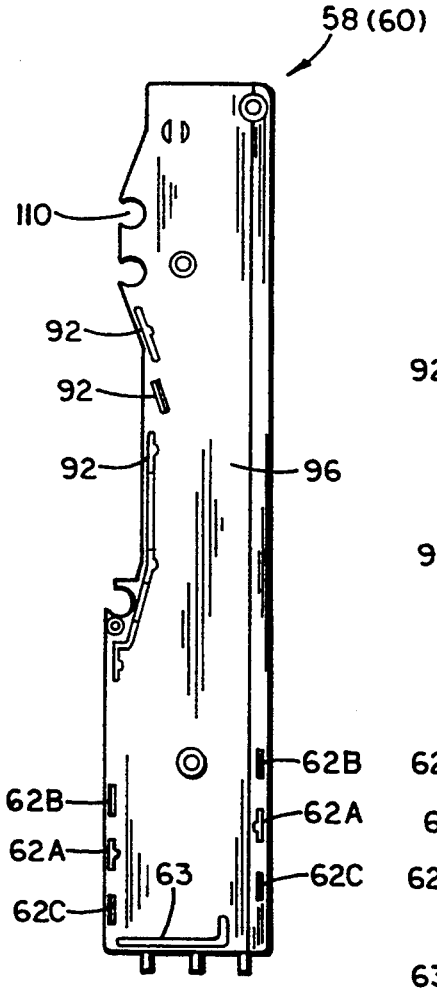
FIGS. 9–12 are orthogonal views of an end piece for engaging the housing and the stepped reflector shown in FIG. 3.
Figure 10:
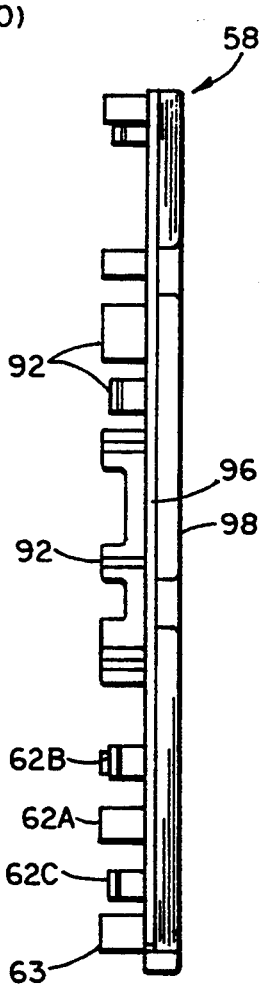

Housing 34 (FIG. 3) includes an elongated C-shaped member 48 having a bottom leg 50, a front leg 52 and a top leg 54 defining a pocket 55. Slots 56 are located in top plate 54 adjacent the ends of elongated member 48. Housing 34 further includes end pieces 58 and 60. End pieces 58 and 60 each include resilient hook-shaped tabs 62 for snap-lockingly engaging slots 56 to secure end pieces 58 and 60 to elongated member 48. End pieces 58 and 60 further include a ridge 63 for supporting front leg 52 in order to stably support the C-shaped profile of housing 34. The tabs 62 (FIG. 9) are arranged so that the middle tab 62A opposes end tabs 62B and 62C, however it is contemplated that different arrangement of tabs can be used. Also, adhesive and/or other fastening means can be used to more securely retain end pieces 58 and 60 to member 48 if desired.

A pair of mounting tabs 64 (FIG. 3) are formed in top leg 54. A transformer 66 for converting electrical power to operate light source 38 is positioned in the pocket 55 defined by elongated member 48. Transformer 66 includes flanges 68 at each end for engaging mounting tabs 64. An electrical cable 70 includes a three prong male plug 72 for operably connecting to a standard electrical outlet, a cord 74 for carrying electrical power, and a female plug 76 located opposite male plug 72. Female plug 76 is configured to engage a notch 78 in the center of top plate 54 so that transformer 66, an on/off switch 80 (FIG. 1), and a dimmer switch 82 can be operably connected thereto. A bottom leg 50 includes an aperture for holding switch 80 and a second aperture for holding dimmer 82. A grounding flange 84 (FIG. 3) is formed in top leg 54. Grounding flange 84 includes a hole 86 engageable by a screw (not shown), such that flange 84 can be used as an electrical ground. A pair of depressions 88 are formed in opposing ends of top leg 54, and tabs 90 are extended partially over depressions 88. A bracket (not shown) can be extended into depressions 88 between depressions 88 and tabs 90 for securing light assembly 30 to the overhead shelf 36.

Figure 11:
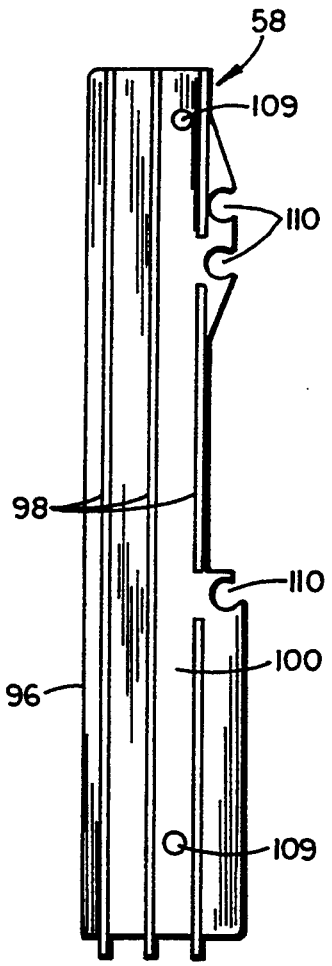
Figure 12:
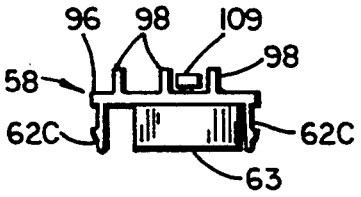

End pieces 58 and 60 (FIGS. 9–12) are mirror images of each other, and thus only end piece 58 is described hereinafter. In addition to tabs 62 and ridge 63, end piece 58 further includes interlocking tabs 92A, 92B and 92C for snap-lockingly engaging slots 94 on the end of step reflector 40 (FIG. 3). End piece 58 further includes a planar body or panel 96. Three reinforcement ribs 98 are located on the outside of panel 96. The top two ribs 98 define a space 100 therebetween for receiving an elongated U-shaped spring bracket 102 (FIG. 3). Bracket 102 includes a leaf spring simulating member 104 that extends from the rearward end 106 of bracket 102 generally rearwardly and inwardly at an acute angle. Bracket 102 includes key holes 108 for receiving and slip locking onto headed screws or tabs 109 located in space 100 (FIGS. 11 and 12) which protrude from the exterior of patrol 96. Panel 96 also defines one or more C-shaped notches 110 for releasably engaging and holding cord 74 in a desired location on light assembly 30. Female florescent bulb receptacles 112 (FIG. 3) are secured inside of and adjacent each of end pieces 58 and 60 in a notch 113. Female receptacles 112 are electrically connected to transformer 66, on/off switch 80, dimmer 82 and female power plug 76. A light source support surface 114 is formed on female plug 76, and plug 76 extends partially through an aperture 116 centrally located in reflector 40.

Figure 13:
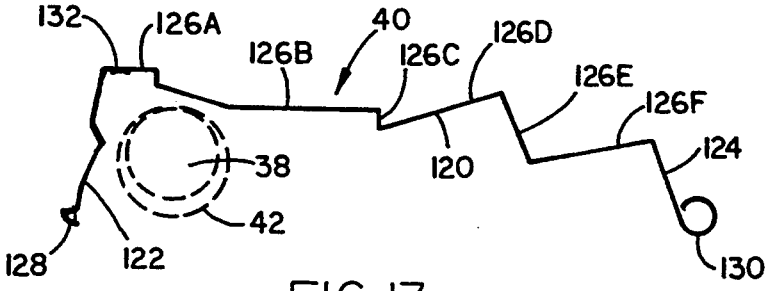
FIG. 13 is a side view of the step light reflector shown in FIG. 3.

Step reflector 40 (FIG. 3) is supported between end pieces 58 and 60 generally rearwardly of housing 34 and over light source 38. The bottom surface 120 of step reflector 40 (FIG. 13) is a mirror-like highly reflective surface for reflecting a maximum amount of light from light source 38. Step reflector 40 includes a forward section 122 generally adjacent light source 38, a rearward section 124 generally remote from light source 38, and a series of step sections 126A–126F interconnecting sections 122 and 124 which are located generally above and rearwardly of light source 38. A folded flange 128 stiffens and stabilizes front section 122, and a rounded flange 130 stiffens and stabilizes rear section 124. Venting apertures 132 are located above light source 38 to vent hot air from around light source 38. Surfaces 126C, 126E and 124 are particularly oriented to reflect light from light from light source 38 generally forwardly into predetermined areas in predetermined patterns below step reflector 40. The specular reflective bottom surface of step reflector 40 preferably has the following characteristics (although it is noted that other reflectivities will work generally satisfactorily): 1) 84 minimum total reflectance and 2) 80 minimum image clarity, distinction of image. For example, specular material manufactured by Lorin Industries, Muskegon, Mich., will work satisfactorily for the reflector.

Figure 14:
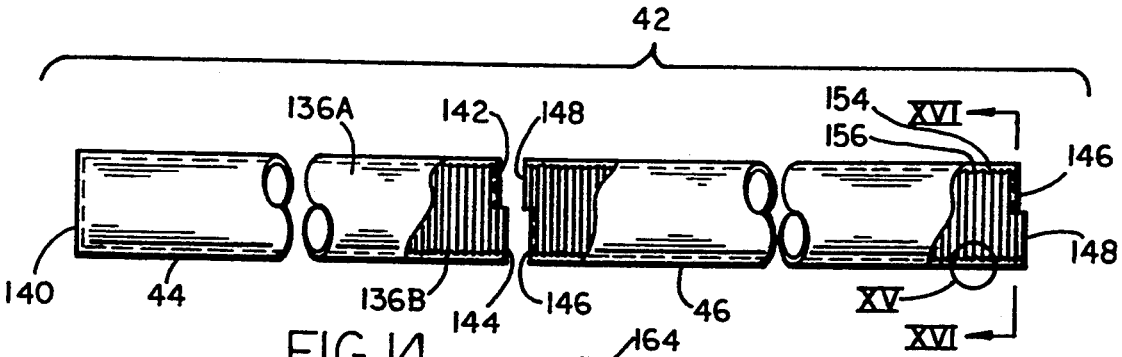
FIG. 14 is an exploded, fragmentary view of the tubular lens.
Figure 17:
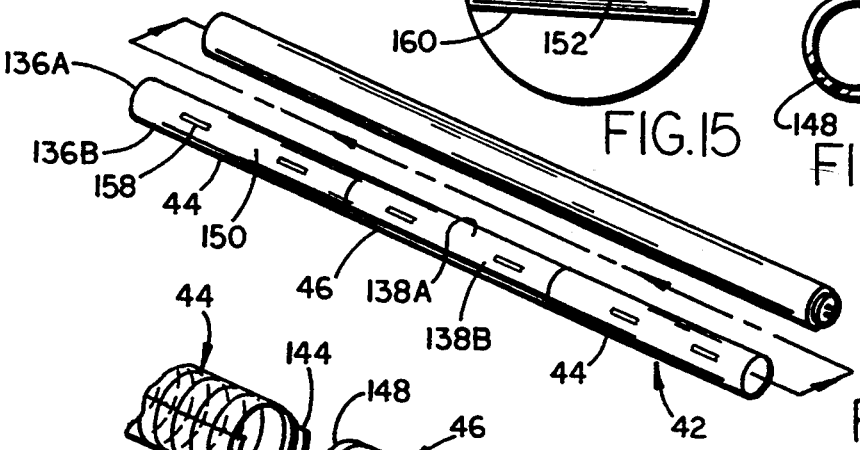
FIG. 17 is a perspective view showing assembly of the tubular lens to a fluorescent light bulb.
Figure 18:
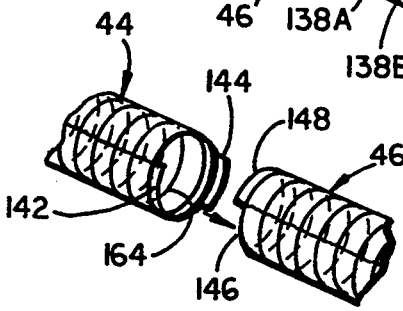
FIG. 18 is a fragmentary, perspective view showing assembly of the tubular lens sections together.

Tubular lens 42 (FIG. 14) is a transparent plastic lens that telescopingly slides onto light source 38 to distribute light from light source 38. The tubular lens 42 illustrated in FIG. 17 is an assembly of two end sections 44 and an intermediate section 46. It is noted that zero, one or more intermediate sections 44 can be used to configure a lens having a desired length to match the light source with which it is being used.

End section 44 (FIG. 14) includes a tab-less flat end 140 and an inner end 142. Inner end 142 includes two arcuate tabs 144 that extend 90° around end section 44 on opposing sides thereof. Tabs 144 are configured to interlockingly engage and register against corresponding tabs on an adjacent end section (46). Alternatively, intermediate section 46 includes ends 146 that include interlocking tabs 148 identical to tabs 144. Thus, one or more intermediate sections 46 can be inserted between end section 44 to custom build a tubular lens of desired length to match any standard fluorescent bulb.

Figure 15:
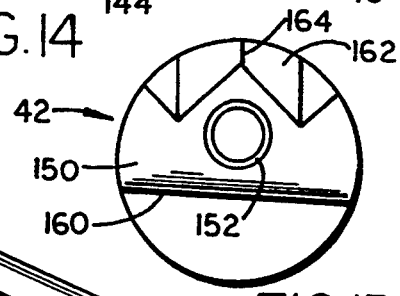
FIG. 15 is an enlarged view of the circled area labeled 15 in FIG. 14.
Figure 16:
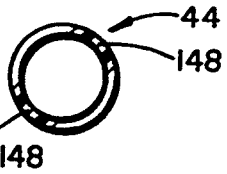
FIG. 16 is a cross-sectional view taken along the plane XVI—XVI in FIG. 14.

End section 44 is made from a pair of identical semicylindrical shells 136A and 136B (FIG. 17). Each shell 136A and 136B includes a single tab 144 on its inner end. Each shell 136A and 136B further includes a first longitudinally extending edge 150 having recesses 152 (FIG. 15) and a second longitudinally extending edge 154 having posts 156 (FIG. 14) for mateably fitting into recesses 152. At least two depressions 158 (FIG. 17) are formed along the longitudinal edges 150 and 154 for venting hot air from around light source 38. Intermediate section 46 is also made from opposing identical halves 138A and 138B. These opposing halves are identical to shells 136A and 136B except that tabs 148 are included on both longitudinal ends.

The outer surface 160 (FIG. 15) of tubular lens 42 is smooth and cylindrically-shaped. The inner surface 162 of tubular lens 42 includes a plurality of prism-shaped rings 164 having a triangular cross-sectional appearance. The triangular shape of rings 164 causes a wide dispersion of the light from light source 38. Further, since lens 42 fully surrounds light source 38, substantially all glare and concentrations of light are eliminated. The combination of rings 164 and the step sections in step reflector 40 cause the side-to-side and front-to-rear dispersion of light to be within an acceptable pattern.

Figure 19:
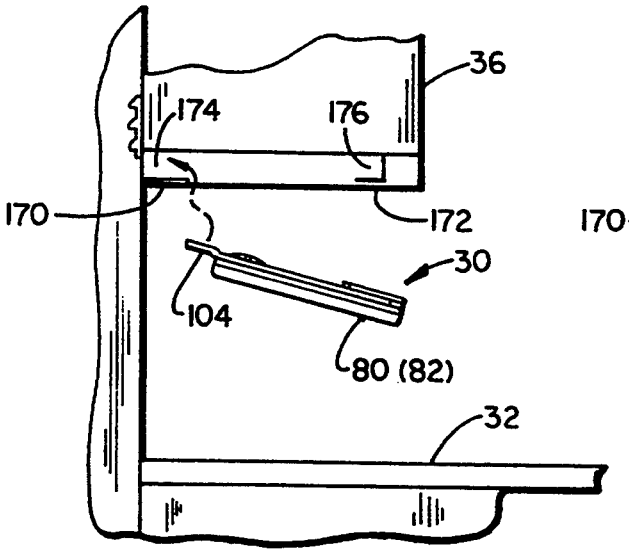
FIGS. 19–20 are side schematic views showing installation of the light assembly to the bottom of an overhead cabinet or shelf.
Figure 20:
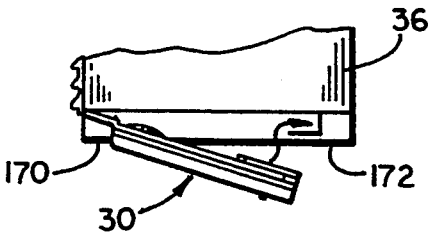

FIGS. 19–20 illustrate the installation of light assembly 30 to the bottom of a shelf 36. Shelf 36 includes brackets 170 and 172 forming opposing concave spaces 174 and 176 on the bottom of shelf 36. Light assembly 30 is positioned so that rear of light assembly 30 is moved into space 174 and spring 104 is compressed. The front of light assembly 30 is then moved into position within space 176 such that springs 104 bias light assembly into a secure position between spaces 174 and 176 under shelf 36. Notably, the on/off switch 80 and dimmer 82 are positioned under housing 34 at the front of light assembly 30 for easy access.

Thus, a light assembly is provided for illuminating a worksurface below and in front of the light assembly. The light assembly includes an elongated housing, an elongated linear light source supported in the housing, a stepped reflector supported by the housing for reflecting light generated by the light source, and a tubular lens mounted on the light source including prisms for controlling the light onto the worksurface. Sections of the tubular lens are provided for engaging each other to provide a tubular lens assembly having a selected length.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A light assembly for illuminating a task supported on a horizontal surface below and in front of the light assembly, comprising:

an elongated housing configured for mounting over the horizontal surface, said elongated housing including a front portion;

an elongated linear light source supported in said housing;

controls for operating said light source located in said front portion;

a reflector supported by said housing for reflecting light generated by said light source onto the task; and a tubular lens having prism-shaped rings located on an inside surface mounted on said light source for controlling the light from the light source.

2. A light assembly as defined in claim 1 including a transformer located in said front portion, said transformer being operably connected to said light source for operating said light source.

3. A light assembly as defined in claim 1 including a switch located in said front portion and electrically connected to said light source for operating said light source.

4. A light assembly as defined in claim 1 including a dimmer located in said front portion and electrically connected to said light source for operating said light source.

5. A light assembly as defined in claim 1 wherein said reflector is a step reflector and includes at least three segments oriented to reflect light from said light source toward a front portion of the horizontal surface.

6. A light assembly as defined in claim 1 wherein said reflector includes a specular reflective surface.

7. A light assembly as defined in claim 1 including end pieces mounted on the ends of said housing, said end pieces being configured to facilitate securing said light assembly to the bottom of an overhead without the use of separate fasteners.

8. A light assembly as defined in claim 1 wherein said tubular lens includes longitudinally extending slots for permitting heated air to pass through said slots away from said light source.

9. A light assembly as defined in claim 1 wherein said tubular lens includes a pair of semi-cylindrical shells secured together to form a cylindrically-shaped tube.

10. A light assembly as defined in claim 9 wherein each of said shells includes longitudinally extending edges, said edges including mating posts and recesses which interlockingly engage to locate said longitudinally extending edges relative to each other.

11. A light assembly as defined in claim 1 wherein said tubular lens includes a smooth outer surface and a configured inner surface, said inner surface defining multiple prisms for dispersing the light generated by said light source.

12. A light assembly as defined in claim 1 wherein said tubular lens includes two end sections, said end sections including an inner end and an outer end, said inner ends including tabs which interlockingly engage and register against each other when said inner ends are brought into engagement with each other.

13. A light assembly as defined in claim 12 wherein said tubular lens includes at least one intermediate section, said intermediate section including second longitudinally extending tabs configured to mateably engage said tabs on said end section, such that said tubular lens can be selectively assembled to a desired length by selectively engaging a pair of end tubular lens sections with one or more of said intermediate sections.

14. In combination, a furniture article of the type having an overhead storage unit with a bottom, and a light assembly secured to the bottom of the overhead storage unit for illuminating a worksurface below and in front of the overhead storage unit, the light assembly comprising:

an elongated housing configured for mounting over the horizontal surface;

an elongated linear light source supported in said housing, said light source defining a longitudinal direction;

a step reflector supported by said housing for reflecting light generated by said light source onto the task; and a tubular lens mounted on said light source for controlling the light from the light source, said tubular lens including prism-shaped rings located on an inside surface of said tubular lens.

15. A combination as defined in claim 14 wherein said tubular lens includes two end sections, said end sections including an inner end and an outer end, said inner ends including tabs which interlockingly engage and register on each other when said inner ends are brought into engagement.

16. A lens assembly for use with an elongated linear light source to control light from the light source, comprising:

first and second tubular lens sections, each of said lens sections defining an interior space for telescopingly receiving the light source, said first and second lens sections including inner ends including tabs configured to engage and register against each other, said lens sections further including prism simulating surfaces which control light from the light source.

17. A lens assembly as defined in claim 16 wherein said prism simulating surfaces include a plurality of triangularly shaped rings extending circumferentially around said first and second lens sections.

18. A lens assembly as defined in claim 16 wherein said first lens section includes a pair of semi-cylindrically-shaped shells, said shells including longitudinally extending edges which mateably engage to form said first lens section.

19. A lens assembly as defined in claim 18 wherein said longitudinally extending edges include depressions which define longitudinally extending slots when said shells are assembled together for emitting heated air located around the light source.

20. A lens assembly as defined in claim 18 wherein said longitudinally extending edges include recesses and mating posts for engaging said recesses to locate said longitudinally extending edges relative to each other upon assembly.

21. A lens assembly as defined in claim 18 wherein said shells are identical in shape.

22. A lens assembly as defined in claim 16 wherein said first and second lens sections include a smooth exterior surface and an interior surface, said interior surface including a plurality of ring-shaped prisms for controlling light.

23. A lens assembly as defined in claim 16 wherein said tubular lens includes a pair of end tubular lens sections and an intermediate tubular lens section, said end tubular lens section including an outer end defining a substantially flat surface, said intermediate lens section including longitudinally extending tabs on each of its ends engageable with said tabs on said inner end of said end tubular lens sections, such that said tubular lens can be selectively assembled to a desired length by engaging a pair of end tubular lens sections with a selected number of said intermediate tubular lens sections.

24. A tubular lens section for controlling light from a linear light source, comprising:

first and second semi-cylindrical lens halves secured together to form a tubular member, said tubular member defining a space for telescopically receiving the linear light source, said lens halves including an inside surface and an outside surface, one of said inside surface and said outside surface defining prism-shaped triangular rings for controlling light from the light source, said first lens half defining a longitudinal edge having recesses and said second lens half defining a longitudinal edge having posts for mateably engaging said recesses to locate the longitudinal edge of said second lens half on the longitudinal edge of said first lens half.

25. A tubular lens module as defined in claim 24 wherein said first and second lens halves are identical in shape.

26. A tubular lens module as defined in claim 24 wherein said prism-shaped triangular rings are located on said inside surface of said lens halves.

27. A tubular lens module as defined in claim 24 wherein said first and second semi-cylindrical lens halves each include longitudinally extending tabs on at least one of the ends of said lens halves, said tabs being configured to engage corresponding tabs on an adjacent tubular lens sections to register said tubular lens section on said adjacent tubular lens section.

28. A light assembly for illuminating an area, comprising:

an elongated housing configured for mounting to an overhead structure;

a linear light source operably mounted in said elongated housing;

a specular reflector supported by said housing for reflecting light generated by said light source in a controlled, directed manner; and a tubular lens having prism-shaped rings mounted on said light source for controlling the light from the light source.

29. A light assembly as defined in claim 28 wherein said specular reflector has a reflective surface bent into discrete sections for reflecting light in predetermined directions and patterns.

30. A light assembly as defined in claim 29 wherein said reflective surface has a total reflectivity of 84 minimum and a clarity of image of 80 minimum.

31. A light assembly as defined in claim 29 wherein said linear light source defines a longitudinal direction and said specular reflector defines a width transverse to said longitudinal direction, said light source being located offset from the center of said transverse width.

32. A light assembly as defined in claim 28 wherein said prism-shaped rings controls light in a first direction longitudinally, and said specular reflector controls light in a second direction generally perpendicular to said first direction.

33. A light assembly as defined in claim 29 wherein said sections define multiple concave sections across said specular reflector, said concave sections extending parallel said linear light source.

* * * * *